US012305952B2

(12) United States Patent
Cox

(10) Patent No.: US 12,305,952 B2
(45) Date of Patent: May 20, 2025

(54) SYSTEMS AND METHODS RELATED TO SELECTIVE CAPTURE OF SPENT SHELL CASINGS

(71) Applicant: Philip Cox, Wheelersburg, OH (US)

(72) Inventor: Philip Cox, Wheelersburg, OH (US)

( * ) Notice: Subject to any disclaimer, the term of this patent is extended or adjusted under 35 U.S.C. 154(b) by 0 days.

(21) Appl. No.: 18/618,763

(22) Filed: Mar. 27, 2024

(65) Prior Publication Data

US 2024/0328737 A1 Oct. 3, 2024

Related U.S. Application Data

(60) Provisional application No. 63/492,273, filed on Mar. 27, 2023.

(51) Int. Cl.
*F41A 9/60* (2006.01)

(52) U.S. Cl.
CPC ..... *F41A 9/60* (2013.01)

(58) Field of Classification Search
CPC ..... F41A 9/60; F41A 35/02
USPC ..... 42/98
See application file for complete search history.

(56) References Cited

U.S. PATENT DOCUMENTS

| | | | |
|---|---|---|---|
| 663,262 | A | 12/1900 | Dieterich |
| 1,027,509 | A | 5/1912 | Smiley |
| 1,201,189 | A | 10/1916 | Johnson |
| 1,304,468 | A | 5/1919 | Fernandez |
| 1,337,327 | A | 4/1920 | Rockwell |
| 1,346,329 | A | 7/1920 | Mehta |
| 2,231,978 | A | 2/1941 | Wesson |
| 2,354,277 | A | 7/1944 | Richardson |
| 2,866,289 | A | 12/1958 | Wilcox |
| 3,087,387 | A | 4/1963 | Browning |
| 3,153,296 | A | 10/1964 | Hofstetter |
| 3,153,981 | A | 10/1964 | Brass |
| 3,156,991 | A | 11/1964 | Adams |
| 3,739,685 | A | 6/1973 | Lundgren |
| 3,771,248 | A | 11/1973 | Linehan |
| 4,020,738 | A | 5/1977 | Martinez |
| 4,028,834 | A | 6/1977 | Dobson |
| 4,110,927 | A | 9/1978 | Morris |
| 4,265,042 | A | 5/1981 | Isola |
| 4,334,375 | A | 6/1982 | Olson |
| 4,430,820 | A | 2/1984 | Marsh |
| 4,715,141 | A | 12/1987 | Kohnke |
| 4,903,426 | A | 2/1990 | Bammate |
| 4,959,918 | A | 10/1990 | Perez |
| 5,138,787 | A | 8/1992 | Riddle et al. |
| 5,285,593 | A | 2/1994 | Bammate |
| 5,398,439 | A | 3/1995 | Harless |
| 5,651,208 | A | 6/1997 | Benson |
| 5,934,002 | A | 8/1999 | Blanchet |
| 6,173,520 | B1 | 1/2001 | Bucciarelli et al. |

(Continued)

FOREIGN PATENT DOCUMENTS

DE 4300867 A1 * 7/1993 ..... F41A 9/60

*Primary Examiner* — Bret Hayes
(74) *Attorney, Agent, or Firm* — Smith Keane LLP

(57) ABSTRACT

Systems and methods according to the present invention comprise a selectively engageable system for capturing spent bullet casings. A capture bag may be coupled to a rifle through a cover and slider. The cover holds the bag in place over the rifle ejection port, allowing the user to collect spent bullet casings. The slider allows the user to engage or disengage the system through a tension system.

20 Claims, 11 Drawing Sheets

(56) References Cited

U.S. PATENT DOCUMENTS

| | | | |
|---|---|---|---|
| 6,347,475 | B1 | 2/2002 | Trostel |
| 6,354,035 | B1 | 3/2002 | Niebuhr et al. |
| 7,168,200 | B2 | 1/2007 | Perez et al. |
| 7,380,364 | B1 | 6/2008 | Hanson |
| 7,493,720 | B1 | 2/2009 | Householder |
| 7,941,961 | B1 | 5/2011 | Cooper |
| 8,408,113 | B2 | 4/2013 | Ledbetter, III et al. |
| 9,915,486 | B1 | 3/2018 | Churchill |
| 10,309,738 | B1 | 6/2019 | Vesich et al. |
| 10,545,004 | B1 | 1/2020 | Forbes |
| 2017/0097201 | A1 | 4/2017 | Rosenthal |

* cited by examiner

SYSTEMS AND METHODS RELATED TO SELECTIVE CAPTURE OF SPENT SHELL CASINGS

RELATED APPLICATIONS

This application claims the benefit of U.S. Provisional Patent Application Ser. No. 63/492,273, filed 27 Mar. 2023, and entitled "Systems and Methods Related to Selective Capture of Spent Shell Casings," which is incorporated herein by reference in its entirety.

BACKGROUND OF THE INVENTION

The present invention relates generally to systems and methods to selectively capture spent shell casings that are expelled from a firearm. Related to firearms, bullet cartridges have a few different parts. The actual bullet is jacketed by a shell casing, which holds the bullet in place and also houses powder propellant and a primer, both important for projecting the bullet when firing. In firing a rifle, a firing pin contacts the back end of the cartridge, igniting an explosive charge in the primer and lighting the propellant. This reaction causes rapid gas generation and pressure buildup, which forces the bullet to separate from the casing and propels the bullet out of the rifle barrel at extremely high speeds. Once the bullet is fired, the spent casing must be expelled (either manually or automatically) from the rifle receiver to make way for the next cartridge.

Today, many types of ammunition feature brass bullet casings due to their durability, corrosion resistance, and ease of reloading. Brass bullet casings offer a balance of strength and flexibility and are therefore on of the most popular types of casings in the world. However, due to these strengths and popularity, brass casings are also in high demand and can therefore be expensive, especially for higher-caliber rifles that require larger bullet casings or uniquely sized cartridges that must be specially made. For this reason, and others, many rifle owners choose to collect their spent bullet casings and recycle them into future bullet cartridges to be fired again.

Previous efforts for collecting spent bullet casings include manual removal from the rifle barrel or, if the casing was automatically ejected after firing, manually collecting the casing from the ground. Other efforts involve various forms of bags and/or boxes attached to the rifle barrel at the casing ejection port. However, many of these designs suffer from defects. For instance, if any malfunction were to happen or if the rifle owner had any desire to look into the ejection port to make sure the rifle chamber is clear, many recovery systems required the owner to disassemble the recovery system. These types of systems can lead to dangerous situations wherein the user may accidently attempt to disassemble the recovery system of a loaded rifle. Thus, improved systems and methods for collecting spent bullet casings that allow for safely and swiftly uncovering the ejection port are desired.

SUMMARY OF THE INVENTION

Embodiments of apparatus and methods according to the present invention relate generally to systems and methods for selectively capturing spent shell casings.

According to an aspect of an embodiment of a system according to the present invention, the system includes a cover comprising a body surrounding an opening. The cover includes a longitudinal rail (preferably of geometric cross section, such as circular or rectangular) disposed on a first side of the cover. The system includes a slider supporting the rail along a longitudinal length between a first position and a second position. A bias member (e.g., an elastic cord or rubber band) cooperates with the cover and the slider to bias the cover towards the second position. A catch is supported on the slider to physically contact and maintain the cover closer to the first position than the second position. A bag is supported by the cover, an open end of the bag extending over and/or surrounding a side of the opening on a second side of the cover. The slider is coupled to or includes a rail guide configured to mate with a mounting rail secured to a firearm.

According to another aspect of an embodiment of a system according to the present invention, the catch is movable between a first catch position, in physical contact with the cover, and a second catch position, not in physical contact with the cover. The catch may be spring-biased towards the first catch position. The catch is preferably movable between the first catch position and the second catch position by manual activation of a switch, which may be a rocker switch integrally formed with the catch, the rocker switch being pivotable about a pivot axis located between a push pad and the catch.

According to yet another aspect of an embodiment of a system according to the present invention, the mounting rail is selected from the group consisting of a picatinny rail, an M-Lok rail, a Weaver rail, a KeyMod rail, and a dovetail rail.

According to still another aspect of an embodiment of a system according to the present invention, the rail guide further includes a clamp adapted to secure the rail guide to a mounting rail.

According to a further aspect of an embodiment of a system according to the present invention, the bias member extends through an elastic channel guide.

According to a still further aspect of an embodiment of a system according to the present invention, the bag includes a bag hem and the cover includes one or more rods threaded through the bag hem to register the bag relative to the opening.

According to yet a further aspect of an embodiment of a system according to the present invention, the cover further comprises a protrusion extending from the first side of the cover.

According to an aspect of an embodiment of a method according to the present invention, the method includes the step of providing a system including a cover comprising a body surrounding an opening. The cover includes a longitudinal rail (preferably of geometric cross section, such as circular or rectangular) disposed on a first side of the cover. The system includes a slider supporting the rail along a longitudinal length between a first position and a second position. A bias member (e.g., an elastic cord or rubber band) cooperates with the cover and the slider to bias the cover towards the second position. A catch is supported on the slider to physically contact and maintain the cover closer to the first position than the second position. A bag is supported by the cover, an open end of the bag extending over and/or surrounding a side of the opening on a second side of the cover. The slider is coupled to or includes a rail guide configured to mate with a mounting rail secured to a firearm. The method further includes the step of providing a firearm including the mounting rail and attaching the slider to the mounting rail. The cover is positioned over an ejection port on the firearm.

According to another aspect of an embodiment of a method according to the present invention, the method further includes the step of loading the firearm with one or more ammunition cartridges.

According to still another aspect of an embodiment of a method according to the present invention, the method further includes the step of pulling a trigger of the firearm.

According to yet another aspect of an embodiment of a method according to the present invention, the method further includes the step of collecting spent shell casings in the bag after the trigger is pulled.

According to a further aspect of an embodiment of a method according to the present invention, the positioning step may include the step of activating a switch to release the cover from the first position to allow the biasing member to move the cover into the second position. The positioning step may additionally or alternatively include the step of, with a portion of the cover, contacting and at least partially opening a dust cover on the ejection port.

According to a still further aspect of an embodiment of a method according to the present invention, the method may also include the step of linearly translating the cover from the second position to the first position. The translating step may further include the step of, with a portion of the cover, releasing and allowing a dust cover on the ejection port to close.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
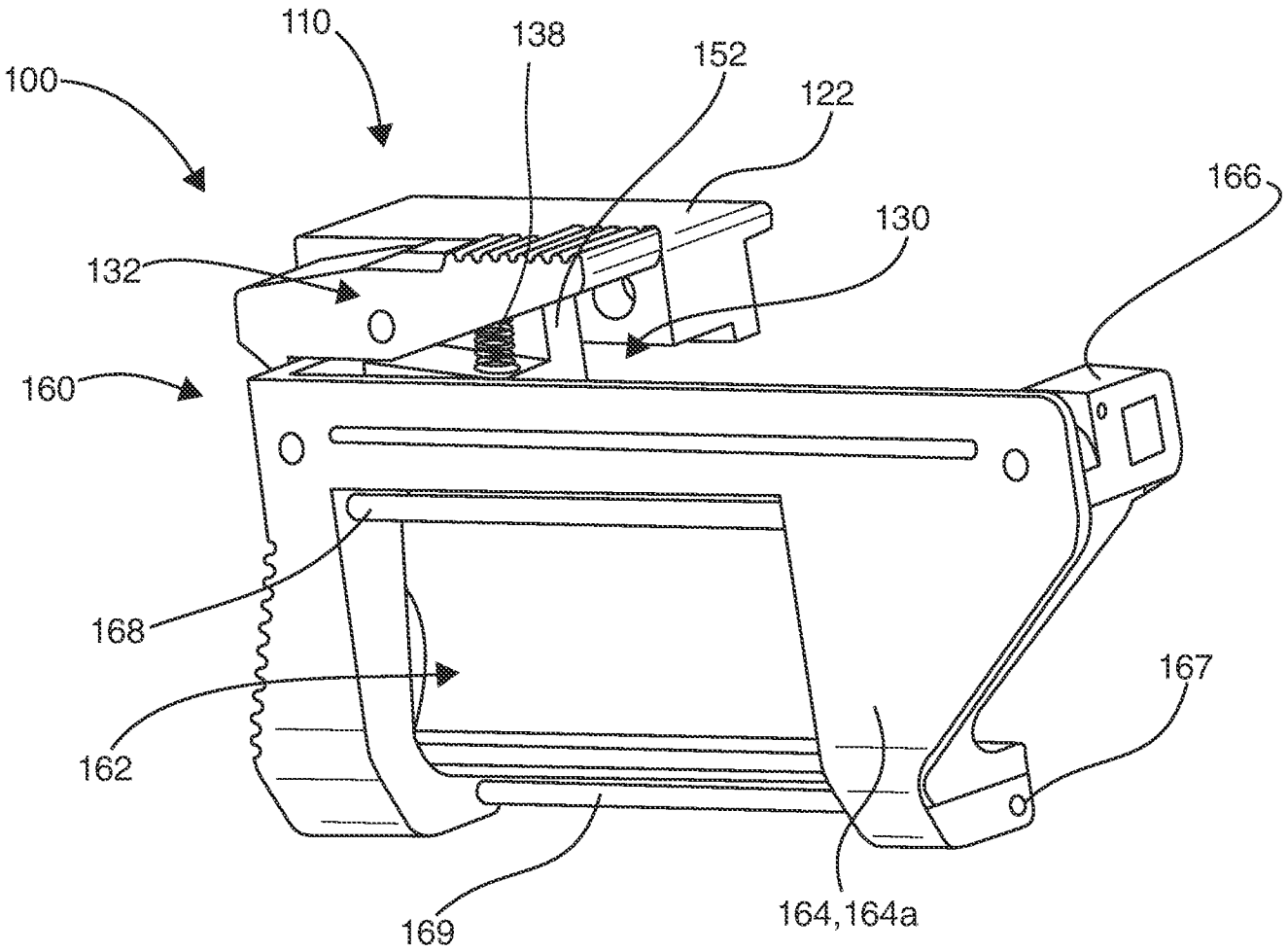
FIG. 1 is perspective view of an embodiment of a slider and cover according to the present invention.

Turning now to Figures, systems and methods for selectively capturing spent shell casings can be seen. As is shown in FIG. 1, a system 100 for selectively capturing spent shell casings preferably comprises a cover 160 slidably coupled to a slider 110 which may be mounted on rifle 10, such as an AR15-style rifle. As seen more completely in FIGS. 10-11, preferably affixed to the cover 160 is a collection bag 180, which catches spent casings upon ejection. In use, the slider 110 attaches to a rifle rail 12 (e.g. a Picatinny, M-Lok, KeyMod rail) using an accessory rail, bracket, or clamping around the rifle 10 and acts to deploy the cover 160 and bag 180 from a disengaged position 100*b* into an engaged position 100*a* outside the rife ejection port 14 to retrieve spent shell casings as they are expelled from the rifle 10 through an ejection port 14. Each part of the slider 110 and cover 160 may be made of hard plastic or other durable material, including aluminum. Parts may even be 3D-printed (e.g. fused deposition modeling, stereolithography, or selective laser sintering) using thermoplastics and/or thermosetting plastics. The slider 110 is preferably removably attached to the cover 160 through adhesive, fasteners, or other means.

Figure 2:
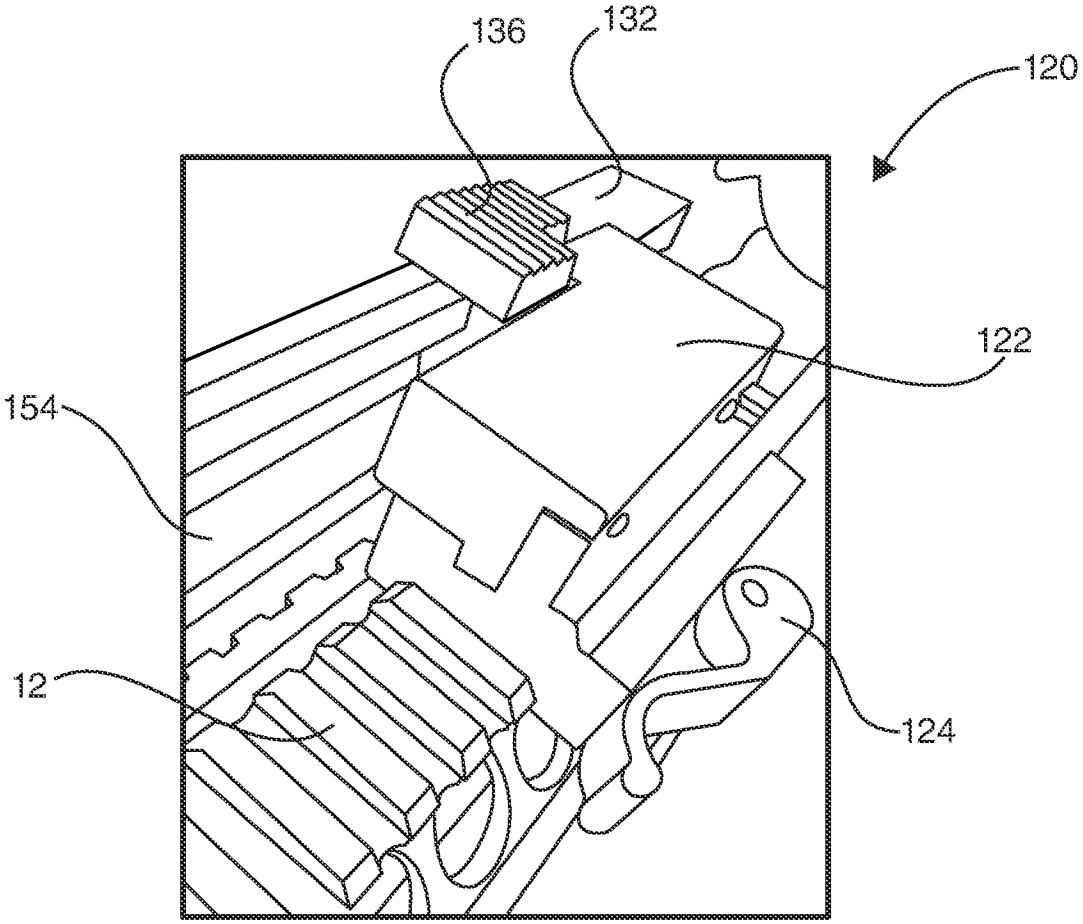
FIG. 2 is a perspective view of an embodiment of a clamp mechanism according to the present invention coupled to a rifle rail.
Figure 3:
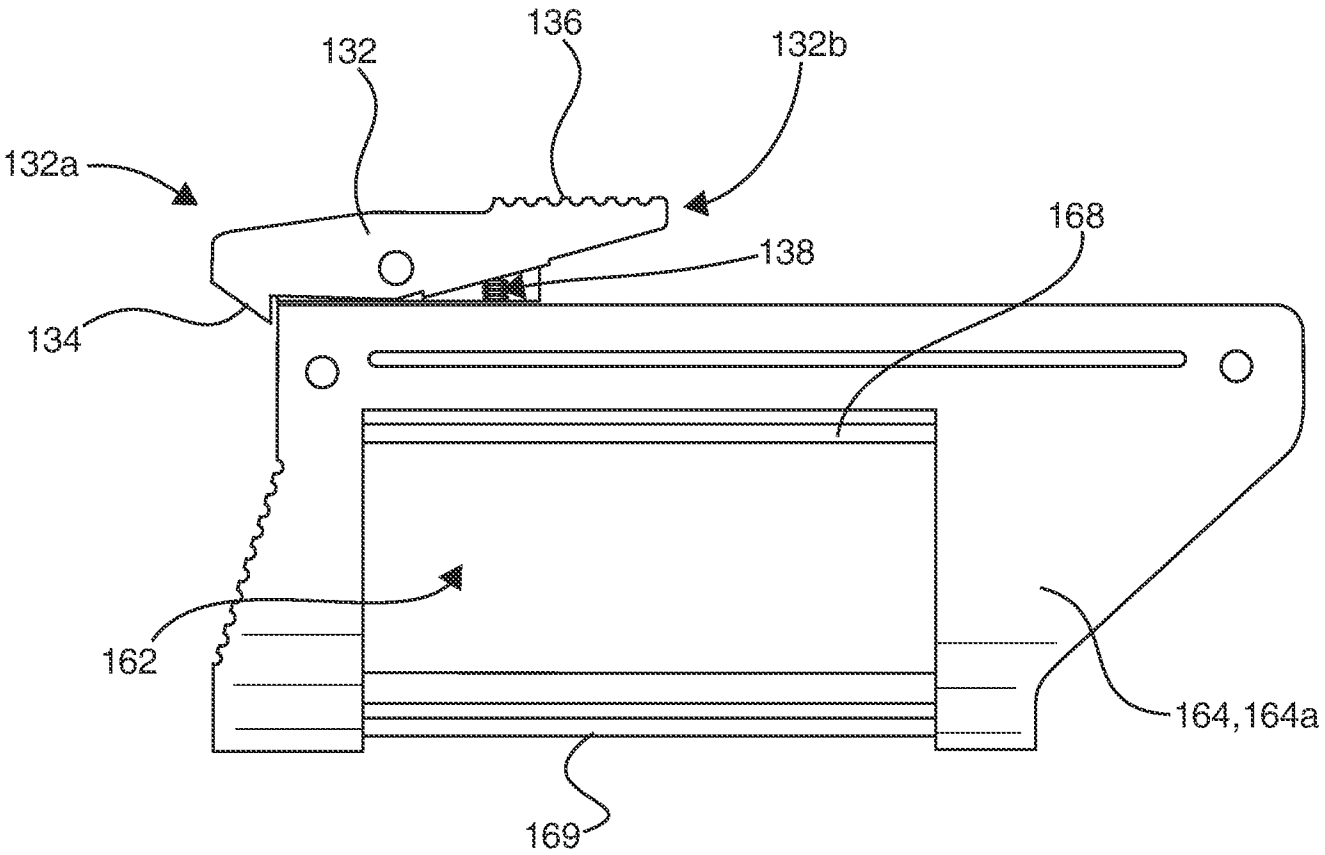
FIG. 3 is a front elevation view of the embodiment of FIG. 1.
Figure 4:
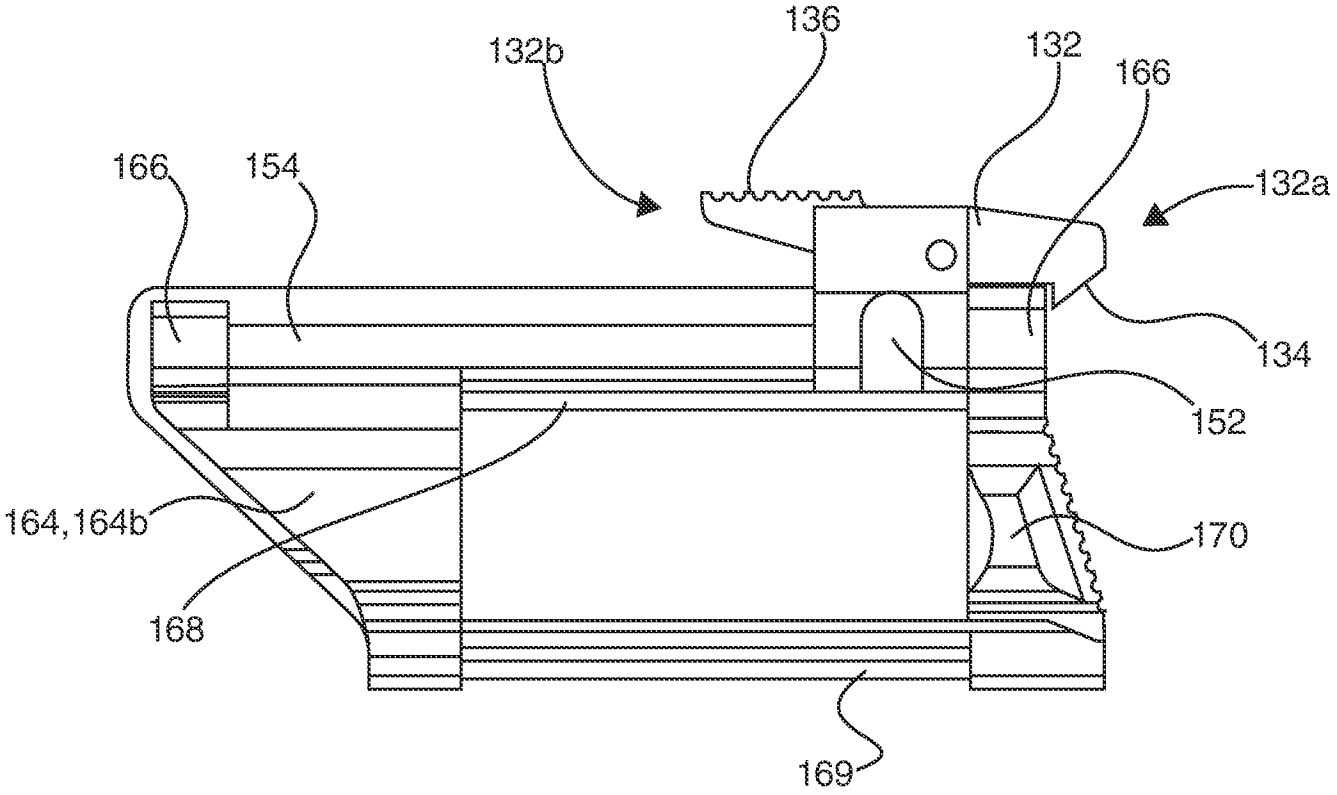
FIG. 4 is a rear elevation view of the embodiment of FIG. 1.
Figure 5:
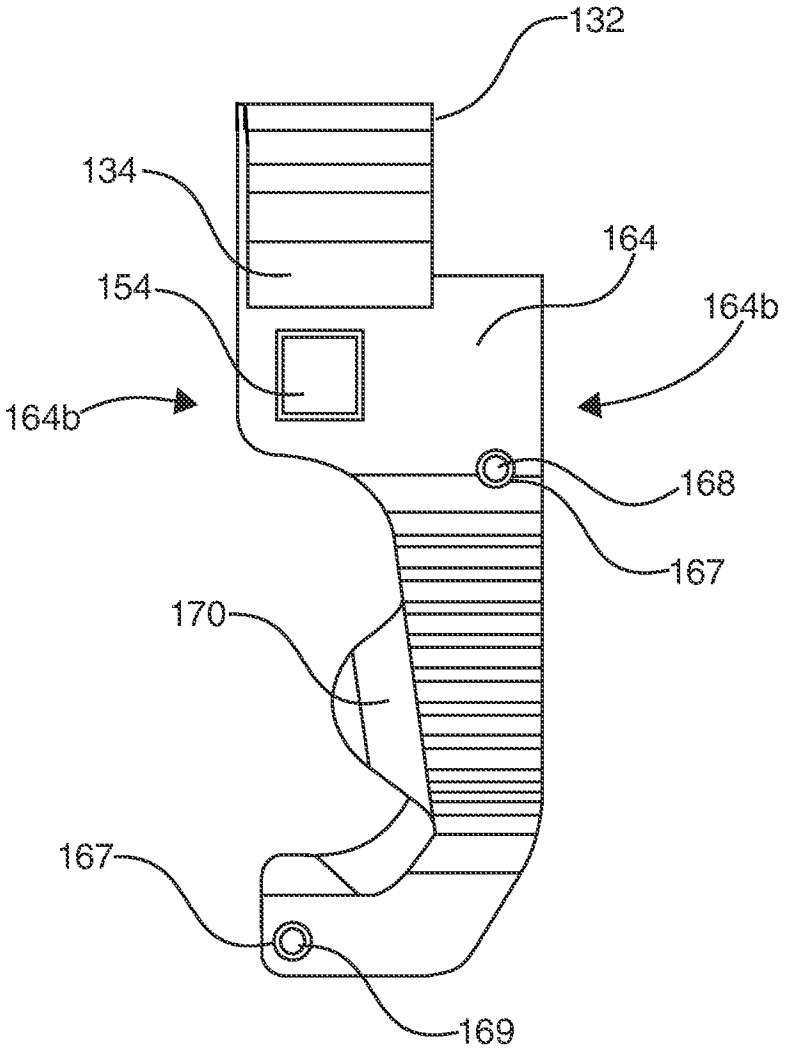
FIG. 5 is a left elevation view of the embodiment of FIG. 1.
Figure 6:
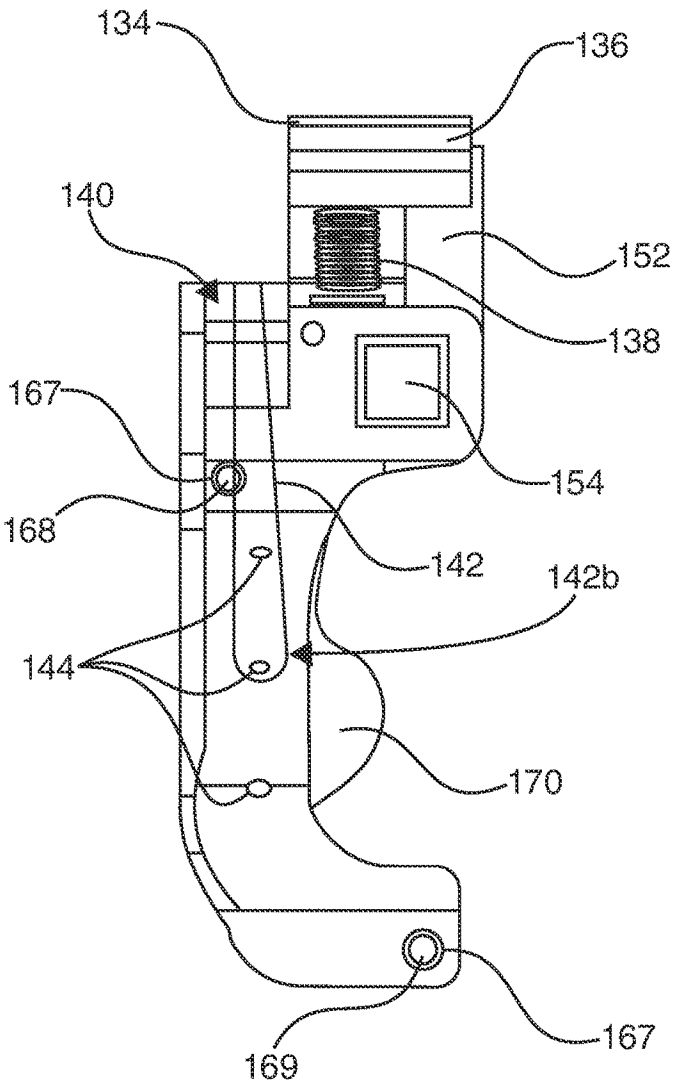
FIG. 6 is a right elevation view of the embodiment of FIG. 1.
Figure 7:
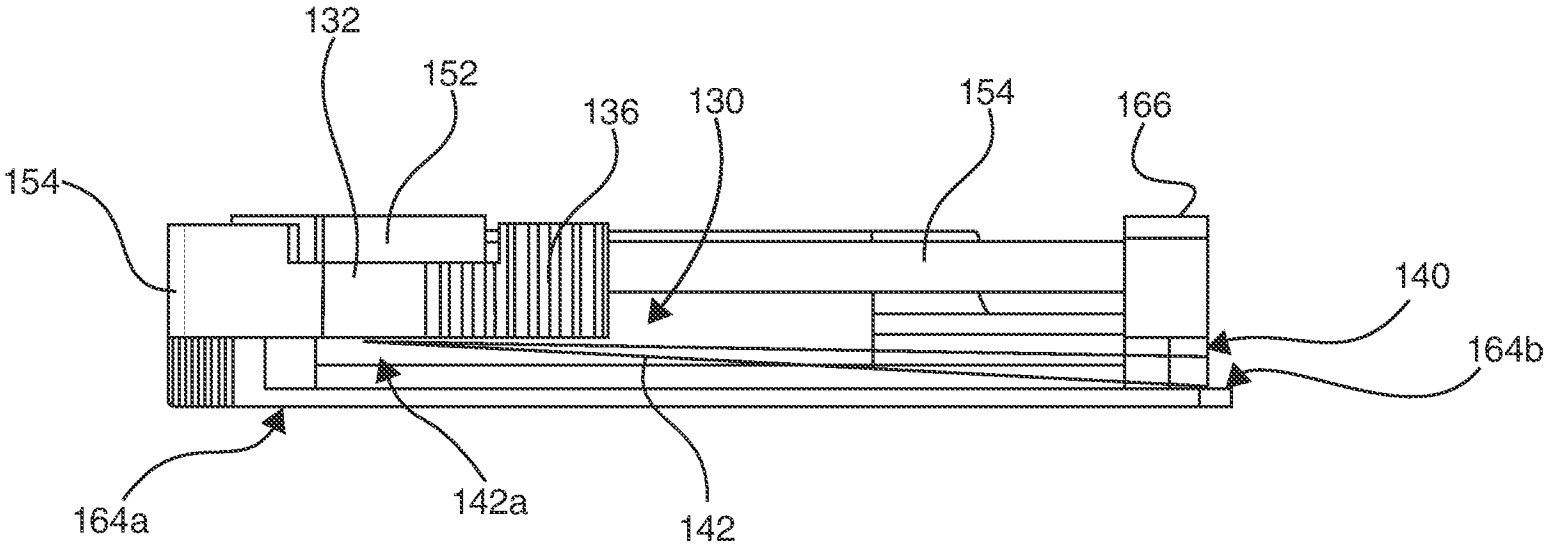
FIG. 7 is a top plan view of the embodiment of FIG. 1.
Figure 8:
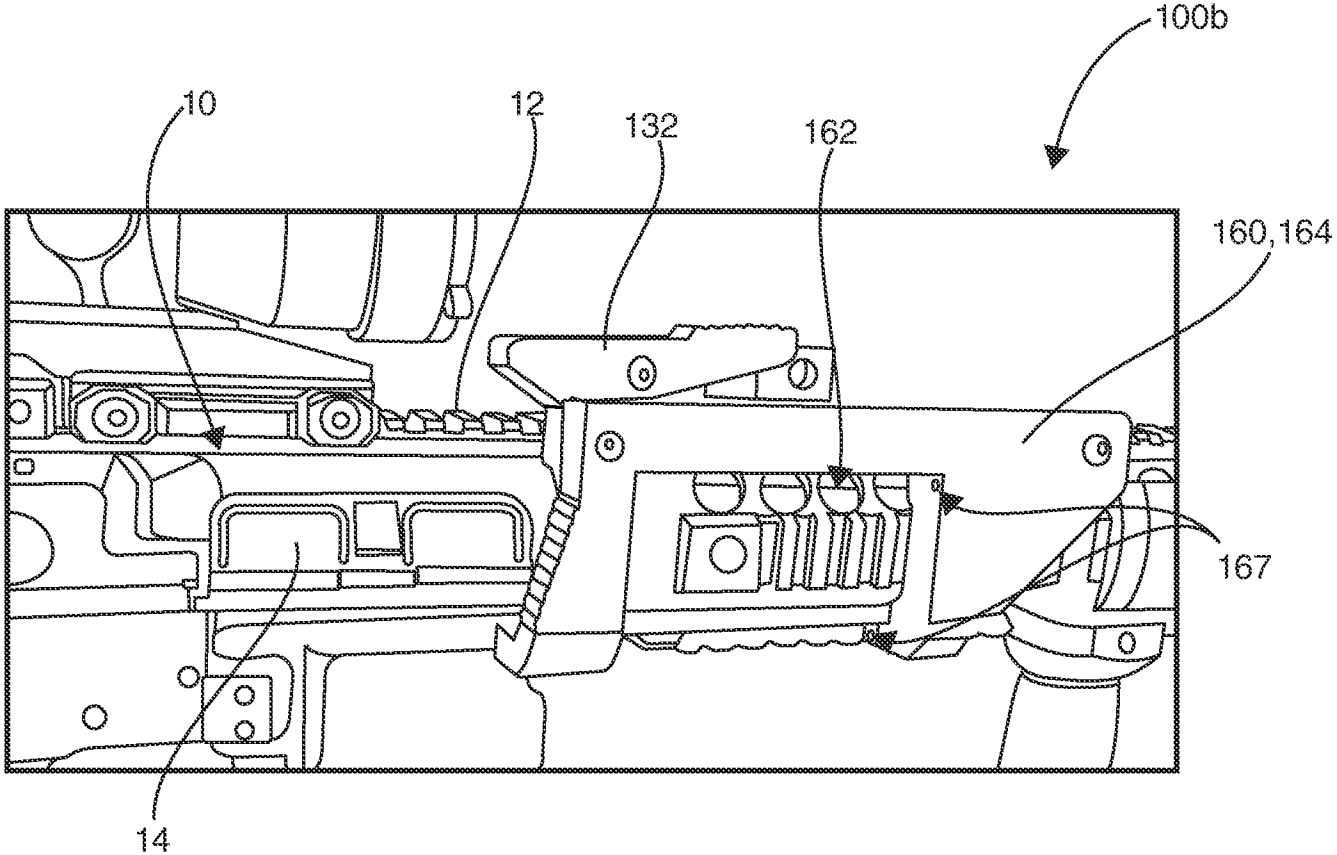
FIG. 8 is a perspective view of the embodiment of FIG. 1 installed on a rifle in a disengaged position.
Figure 9:
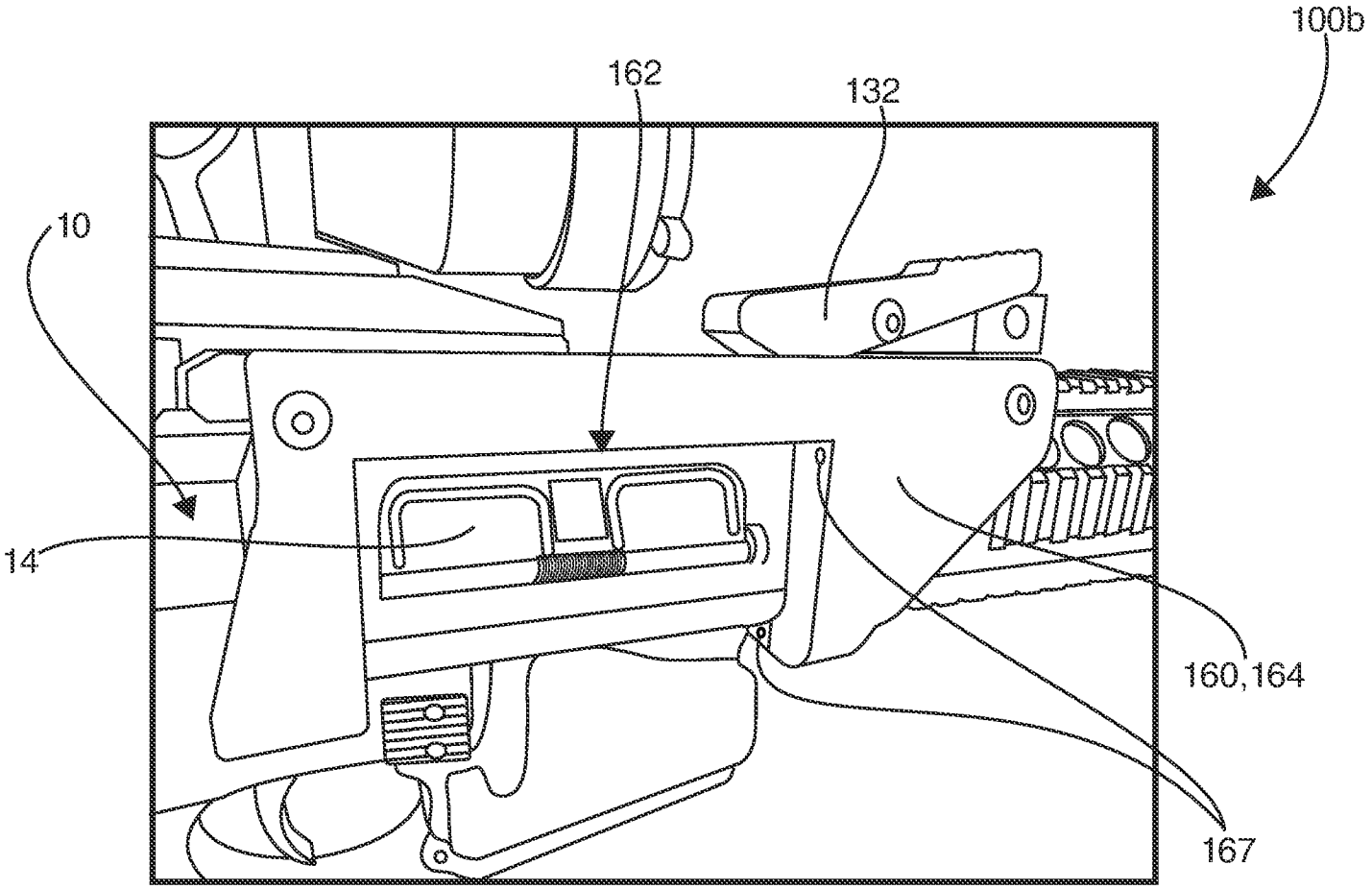
FIG. 9 is a perspective view of the embodiment of FIG. 8 in an engaged position.

Turning to FIGS. 1-2, the slider 110 comprises a clamp mechanism 120 and tension system 130. When installing the system 100, the clamp mechanism 120 holds the slider 110 on the rifle rail 12 to provide stability and prevent movement of the system 100. In some embodiments, like those of FIG. 2, the clamp mechanism 120 comprises a rail guide 122 with a spring-biased latch 124. In installation, the rail guide 122 is placed at the desired location over the rifle rail 12 and the latch 124 is engaged, locking the rail guide 122, and the rest of the system 100 by extension, in place on the rifle rail 12. Other forms of latches are also contemplated, including non-spring-biased fasteners, adhesives, or other latching means.

The tension system 130 may be formed integrally with the clamp mechanism 120 or in separate parts and coupled with fasteners. This system 130 preferably comprises an elastic cord 142, which keeps the cover 160 in spring-tension when the cover 160 is in a disengaged position 100*b*, and a sliding mechanism 150. While under tension, the user may engage a trigger, releasing tension in the tension system 130 and engaging the sliding mechanism, which moves the cover 160 from a disengaged position 100*b* to an engaged position 100*a*.

As seen in FIGS. 3-7, a preferred embodiment of the trigger is a switch 132, although alternative trigger embodiments are also contemplated. The switch 132 is preferably configured in a see-saw like formation, having a first end 132*a* spaced from a second end 132*b*, and is preferably coupled to the clamp mechanism 120 and/or sliding mechanism 150 through a fastener located at the center of mass of the switch 132. The first end 132*a* preferably comprises a catch 134 to hold the cover 160 under tension in a disengaged position 100*b*. Pressure on a push pad 136 located on the second end 132*b* of the switch 132 lifts the catch 134, releasing the tension and causing the cover 160 to move into the engaged position. In transitioning back to the disengaged position 100*b* from the engaged position 100*a*, pressure may be applied to the cover 160, forcing it to move away down the rifle 10, towards the muzzle 16 and away from the ejection port 14, until the switch catch 134 can hook onto the cover 160 and hold it in place.

The switch 132 may also preferably comprise a spring 138 located beneath the second end 132*b*. The spring 138 keeps the second end 132*b* pushed upward, which helps keep the catch 134 of the first end 132*a* engaged with the cover 160 to keep the cover 160 in the disengaged position 100*b*. Pressure on the push pad 136 causes the spring 138 to compress and allows the tension to release and the cover 160 to move into the engaged position 100*a* proximate the rifle ejection port 14.

Located proximate to the cover 160, an elastic channel guide 140 defines a space in which the elastic cord 142 may be situated. The elastic cord 142 is preferably a loop of vulcanized rubber, which may be stretched and will snap back to its original shape when tension from stretching is released. A first end 142*a* of the elastic cord 142 may be coupled to the clamp mechanism 120 by looping around a fastener. Similarly, a second end 142*b* of the elastic cord 142 may be coupled to the cover 160 by stretching through the elastic channel guide 140 and down the side of the cover body 164 and looping around a fastener affixed to one of a plurality of elastic cord retaining holes 144 cut into the cover 160. The amount of tension in the elastic cord 142 when the cover is in a disengaged position 100*b* may be adjusted by choosing which retaining hole 144 that the fastener, and by extension the second end 142*b* of the elastic cord 142, is coupled to.

The sliding mechanism 150 preferably comprises a sliding member 152 which slides along a square rail 154 that is coupled to the cover 160 at both ends. The square rail 154 is preferably threaded through the sliding member 152 before being coupled to the cover 160, allowing the sliding member 152 to slide back and forth along the square rail 154. The square rail 154 is preferably made from stainless steel, such that the sliding mechanism 150 experiences little to substantially no friction as it moves along the square rail 154. If the cover 160 is in a disengaged position 100*b* and the switch 132 is engaged, the tension on the elastic cord 142 is released as the cord 142 snaps back into shape, which also pulls the cover 160 into an engaged position 100*a* as the square rail 154 slides through the sliding member 152. During the transition between positions 100*a*-100*b*, or vice versa, the sliding member 152 remains substantially unmoved, as it is coupled to the rifle rail 12 through the clamp mechanism 120. The sliding mechanism 150 may also be coupled to the spring 138 that holds the second end 132*b* of the switch 132 aloft.

The cover 160 preferably comprises a window or opening 162 formed through a body 164, reaching through the body 164 from an exterior face 164*a* to an interior face 164*b*. The exterior face 164*a* preferably faces away from the rifle 10 when the system 100 is installed, while the interior face 164*b* preferably faces towards the rifle 10. The exterior face 164*a* of the body 164 is preferably substantially planar and may feature information regarding the system 100 and the type of firearm it may be compatible with. The interior face 164*b* preferably comprises square rail coupling members 166, which are formed integrally with and extend from the interior face 164*b* and define the range of movement of the sliding member 152 along the square rail 154, since the square rail 154 is suspended between the square rail coupling members 166. The cover 160 may also comprise a protrusion 170, which may engage and at least partially open the dust cover of the ejection port 14 as the system 100 moves to the engaged position 100*a* and disengages the dust cover as the system 100 moves to the disengaged position 100*b*.

When the system 100 is assembled, the square rail 154 may be threaded through apertures in the rail coupling members 166 and affixed into place. The cover 160 also preferably comprises circular rod apertures 167 that extend through the body 164, which accommodate the upper and lower bag rods 168-169. These rods 168-169 are preferably cylindrical steel rods that may be threaded through the rod apertures 167 and serve to hold the collection bag 180 in place over the rifle ejection port 14 when the system 100 is in an engaged position.

Figure 10:
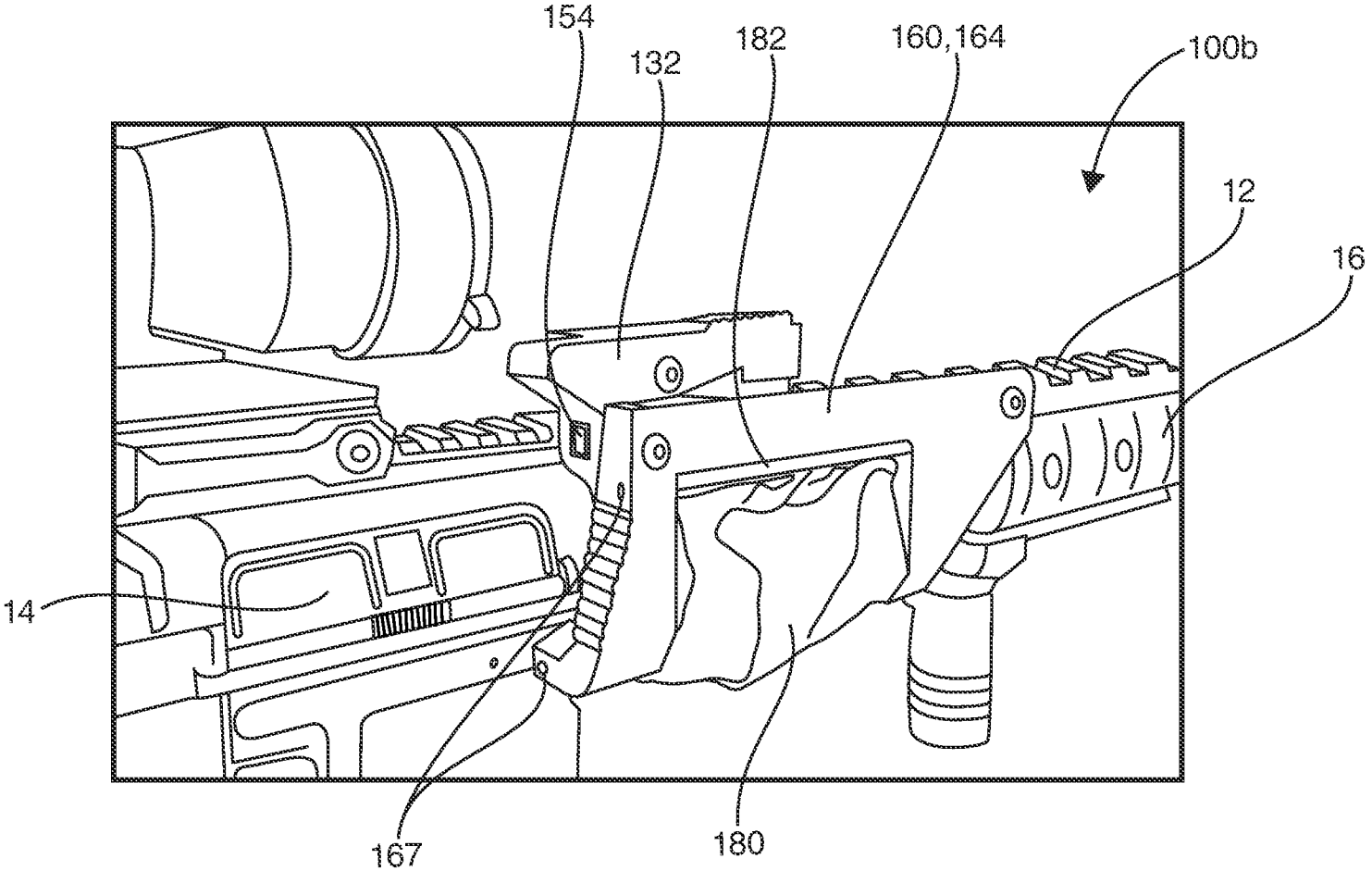
FIG. 10 is a perspective view of an embodiment of a system according to the present invention in a disengaged position.
Figure 11:
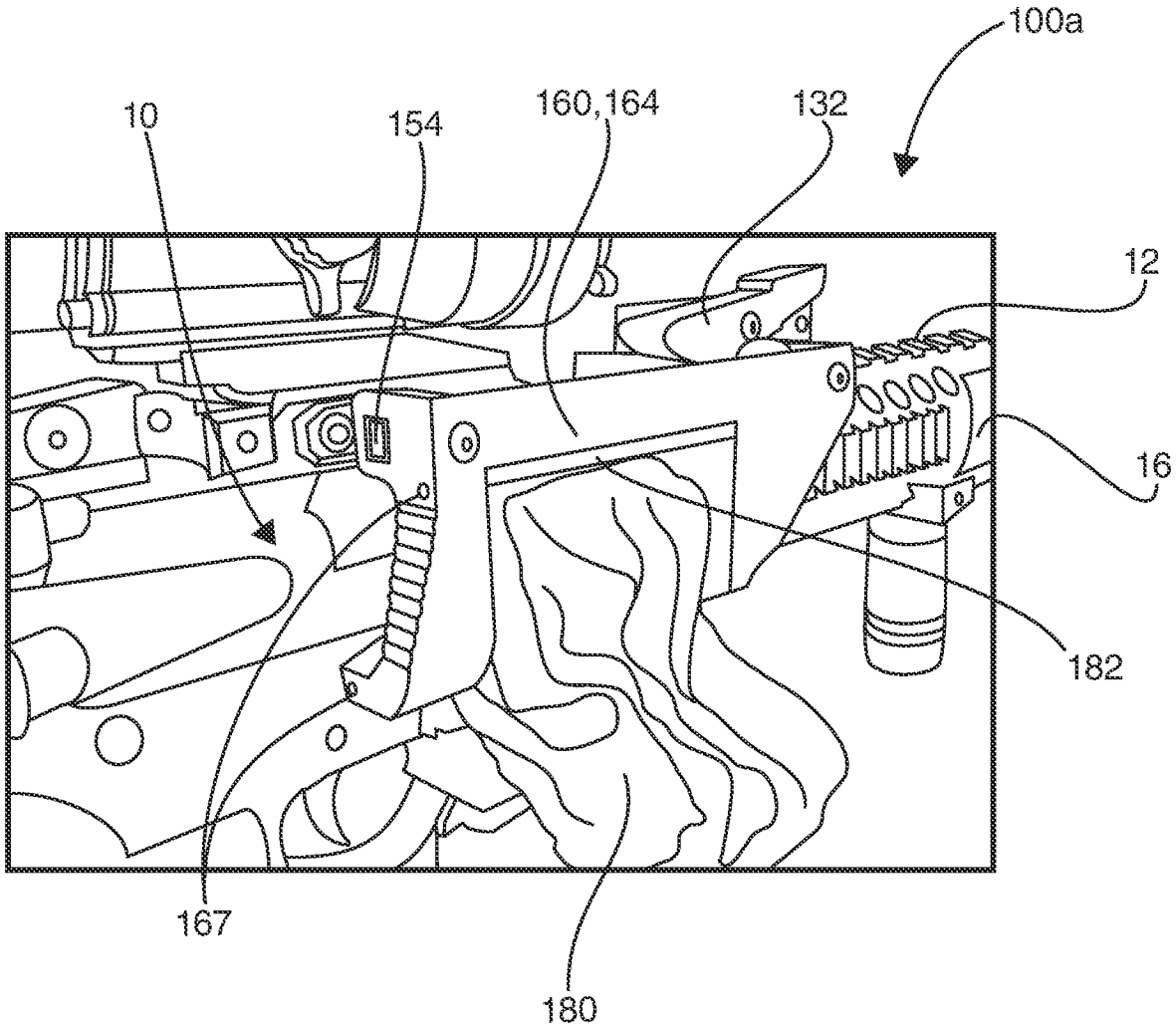
FIG. 11 is a perspective view of the embodiment of FIG. 10 in an engaged position.

The collection bag 180 is preferably made from a durable material, such as nylon or tightly woven cotton or linen. The bag 180 is installed on the system 100 by threading the upper and lower bag rods 168-169 through the bag hem 182 around the opening. Thus, when the rods 168-169 are installed in the system 100 as well and the system is in an engaged position 100*a*, the bag is held in place covering the window 162 of the cover 160. As seen in FIG. 11, when engaged, the cover 160 moves into position, where the rifle ejection port 14 is visible through the cover window 162 and the cover 160 does not inhibit the movement of the ejection port dust cover. As bullet shells are expelled from the rifle ejection port 14, the shells pass through the cover window 162 and are caught by the bag 180. As seen in FIG. 10, when the system 100 is not in use (i.e. when the system 100 is in a disengaged position 100*b*), the bag 180 may preferably be folded onto itself to be stored within the cover window 162.

In use, the clamp mechanism rail guide 122 couples with the rail 12 of a rifle and the latch 124 is engaged to hold the slider 110 in place relative to the rifle 10. In an engaged position, the cover 160 is positioned such that the rail ejection port 14 is visible through the cover window 162 when the bag 180 is not installed.

To reach the disengaged position 100*b* from the engaged position 100*a*, the user need only push the cover 160 towards the rifle muzzle 16, causing the square rail 154 to slide through the sliding member 152, until the catch 134 of the switch 132 engages with one of the square rail coupling members 166. This engagement may be accomplished by slightly pressing down on the switch push pad 136, which lifts the catch 134 slightly, the pushing the square rail coupling member 166 under the catch 134 and releasing the push pad 136, allowing the catch 134 to fall and hook around the square rail coupling member 166. While the user pushes the cover 160 towards the rifle muzzle 16, the elastic cord 142 is being stretched, creating tension in the tension system 130 once the system 100 has reached the disengaged position.

Finally, to return to the engaged position again, the user need only press down on the switch push pad 136, which raises the catch 134 and releases the cover 160. Due to the tension release of the elastic cord 142, the square rail 154 is forced to slide back through the sliding member 152, pulling the cover 160 back towards the rail ejection port 14 until the port 14 is once again visible through the window 162. If the bag 180 is installed at the time of engaging the system 100, the transition from the disengaged position 100*b* to the engaged position 100*a* in some cases may be enough to unfurl the bag 180 from its storage position within the window 162. In other cases, the user can manually unfurl the bag 180 from its storage position so that it is ready to catch bullet casings as they are being ejected from the ejection port 14. Since the user may choose to engage or disengage the system 100, the system 100 is said to be selectively engageable.

The foregoing is considered as illustrative only of the principles of the invention. Furthermore, because numerous modifications and changes will readily occur to those skilled in the art, it is not desired to limit the invention to the exact construction and operation shown and described. For instance, though the term "real-time" is utilized throughout, it is to be and will be understood by those having skill in the art that there is some finite processing time that is necessary or desirable prior to the real-time result, and the term includes such variability. While the preferred embodiment has been described, the details may be changed without departing from the invention.

I claim:

1. A system comprising:

a cover comprising a body surrounding an opening, the cover including a longitudinal rail disposed on a first side of the cover;

a slider supporting the rail along a longitudinal length between a first position and a second position;

a bias member acting on the cover and the slider to bias the cover towards the second position;

a catch supported on the slider to physically contact and maintain the cover closer to the first position than the second position; and a bag supported by the cover, extending over a side of the opening, wherein the slider is one of coupled to and includes a rail guide configured to mate with a mounting rail secured to a firearm.

2. The system of claim 1, wherein the rail has a rectangular cross-section.

3. The system of claim 1, wherein the catch is movable between a first catch position, in physical contact with the cover, and a second catch position, not in physical contact with the cover.

4. The system of claim 3, wherein the catch is spring-biased towards the first catch position.

5. The system of claim 4, wherein the catch is movable between the first catch position and the second catch position by manual activation of a switch.

6. The system of claim 5, wherein the switch and the catch are integrally formed.

7. The system of claim 1, wherein the mounting rail is selected from the group consisting of a picatinny rail, an M-Lok rail, a Weaver rail, a KeyMod rail, and a dovetail rail.

8. The system of claim 1, the rail guide further comprising a clamp.

9. The system of claim 1, wherein the bias member comprises an elastic cord.

10. The system of claim 1, wherein the bias member extends through an elastic channel guide.

11. The system of claim 1, wherein the bag comprises a bag hem and the cover comprises one or more rods threaded through the bag hem to register the bag relative to the opening.

12. The system of claim 1, wherein the cover further comprises a protrusion extending from the first side of the cover.

13. A method comprising the steps of:

providing a system according to claim 1;

providing a firearm including a mounting rail;

attaching the slider to the mounting rail; and positioning the cover over an ejection port of the firearm.

14. The method of claim 13, further comprising the step of loading the firearm with one or more ammunition cartridges.

15. The method of claim 14, further comprising the step of pulling a trigger of the firearm.

16. The method of claim 15, further comprising the step of collecting spent shell casings in the bag after the trigger is pulled.

17. The method of claim 13, wherein the positioning step comprises the step of activating a switch to release the cover from the first position to allow the biasing member to move the cover into the second position.

18. The method of claim 17, the positioning step further comprising the step of, with a portion of the cover, contacting and at least partially opening a dust cover on the ejection port.

19. The method of claim 17, further comprising the step of linearly translating the cover from the second position to the first position.

20. The method of claim 19, the translating step further comprising the step of, with a portion of the cover, releasing and allowing a dust cover on the ejection port to close.

* * * * *